US006730179B2

(12) United States Patent
Kircher

(10) Patent No.: US 6,730,179 B2
(45) Date of Patent: May 4, 2004

(54) METHOD FOR PRODUCING LOCAL ALUMINIDE COATING

(75) Inventor: Thomas Kircher, Biddeford, ME (US)

(73) Assignee: Sermatech International Inc., Limerick, PA (US)

( * ) Notice: Subject to any disclaimer, the term of this patent is extended or adjusted under 35 U.S.C. 154(b) by 0 days.

(21) Appl. No.: 09/944,338

(22) Filed: Aug. 31, 2001

(65) Prior Publication Data

US 2003/0041923 A1 Mar. 6, 2003

(51) Int. Cl.[7] ..... C23C 22/00

(52) U.S. Cl. ..... 148/240; 148/280; 148/283; 427/229; 427/237; 427/253

(58) Field of Search ..... 148/240, 280, 148/283; 427/229, 237, 253

(56) References Cited

U.S. PATENT DOCUMENTS

| | | | | |
|---|---|---|---|---|
| 4,004,047 A | | 1/1977 | Grisik | |
| 4,132,816 A | | 1/1979 | Benden et al. | |
| 4,148,275 A | | 4/1979 | Benden et al. | |
| 4,427,720 A | | 1/1984 | Gauje | 427/237 |
| 4,726,101 A | * | 2/1988 | Draghi et al. | 29/889.1 |
| 5,217,757 A | | 6/1993 | Olson et al. | |
| 5,334,417 A | | 8/1994 | Rafferty et al. | |
| 5,658,614 A | | 8/1997 | Basta et al. | |
| 5,674,610 A | | 10/1997 | Schaeffer et al. | |
| 6,045,863 A | | 4/2000 | Olson et al. | |
| 6,110,262 A | | 8/2000 | Kircher et al. | |
| 6,120,843 A | | 9/2000 | Pillhoefer et al. | 427/253 |
| 6,203,847 B1 | | 3/2001 | Conner et al. | |
| 6,274,193 B1 | | 8/2001 | Rigney et al. | |

FOREIGN PATENT DOCUMENTS

| | | |
|---|---|---|
| EP | 0 837 153 A | 4/1998 |
| EP | 0 984 074 A | 3/2000 |
| FR | 1 134 753 | 4/1957 |

* cited by examiner

*Primary Examiner*—Andrew L. Oltmans
(74) *Attorney, Agent, or Firm*—Drinker Biddle & Reath LLP

(57) ABSTRACT

Method for localized aluminide coating applied for the first time or as repair includes creating a contained space by disposing coating material comprising an aluminum source and a halide activator at least partially over and in an out-of-contact relation with a target surface of a metal substrate. Heating the substrate to a temperature to cause the aluminum source to react with the halide activator and the substrate results in diffusion aluminide coating of the targeted surface. An article comprising a target surface of a metal substrate, said surface bounding a contained space, and a coating tape comprising an aluminum source and a halide activator and disposed in an out-of-contact relation at least partially over the contained space whereby, when the substrate is heated to a temperature to cause the halide activator to react with the aluminum source, a diffusion aluminide coating is formed on the target surface.

17 Claims, 2 Drawing Sheets

METHOD FOR PRODUCING LOCAL ALUMINIDE COATING

FIELD OF THE INVENTION

The present invention relates generally to the field of aluminide coatings diffused onto metal substrates and particularly to targeting the diffusion of the coating to a selected area of the substrate.

BACKGROUND OF THE INVENTION

Diffusing aluminide coatings onto the surface of metal gas turbine components, such as blades, vanes, combustor cases and the like, is a standard way of reducing the untoward effects of oxidation and corrosion on these components, thereby maintaining their useful life. Specifically, aluminide coatings extend the service life of a part used for operation at temperatures usually above 649° C. (1200° F.). Such parts are usually made from nickel or from nickel or cobalt based alloys.

Essentially, all aluminum diffusion coating methods share some common steps for accomplishing the coating: first, the coating material is placed near or in contact with the metal substrate; the coating material and substrate are then heated until the coating material diffuses onto the substrate. More specifically, the placement step involves placing the metal substrate in a retort chamber with a source of aluminum and a halide activator. The source of aluminum may be pure aluminum or an aluminum-rich intermetallic compound such as a chromium-aluminum alloy or $CO_2Al_5$ and the like. The activator may be any number of halide compounds, including an aluminum halide, alkali metal halide, ammonium halide, or mixture thereof. The activator functions to facilitate the deposition of aluminum onto the surface of the metal component.

High heat is then applied to the metal substrate, aluminum source and activator in the retort chamber for a period that ranges from two to twelve hours in an inert atmosphere to prevent the occurrence of oxidation. During the heating step, the halide activator dissociates and reacts with aluminum metal ions from the aluminum source to form Al-halide intermediates, which migrate to the surface of the metal substrate. The Al-halide intermediates "grab" the metal atoms of the metal substrate. These atoms reduce the Al-halide intermediates to create intermetallic compounds, such as $Ni_2Al_3$, NiAl or $NiAl_3$, on and at some depth below the surface of the metal substrate. These intermetallic compounds are aluminides and are generally resistant to high temperature degradation. They are consequently preferred as protective coatings.

Diffusion aluminide coating methods also share a second commonality, called activity or throwing power, which stems from the use of a halide activator. Throwing power relates to the strength of the halide activator in reacting with the aluminum ions in the aluminum source. Throwing power is essentially a measure of the potential that a halide activator has in facilitating a coating reaction. Those halide activators with greater throwing power form more reactive Al-halide intermediates. Accordingly, they can more readily pull the metal atoms of the substrate out of their crystalline structure as well as pull out metal atoms from deeper in the substrate. Halide activators with greater throwing power are able to facilitate a stronger coating reaction, which in turn relates to the thickness of the deposited coating.

Diffusion aluminide coatings thus depend on the chemical reactivity between the aluminum-halide intermediate and the metal atoms of the substrate, which, as just discussed, is a function of the reactivity of the halide activator. Other factors that affect the depth and quality of the coating include the heating temperature and the presence of any other material placed either in the heating chamber or on the surface of the substrate that could inhibit the throwing power of the halide activator.

Essentially, the differences between the various diffusion coating methods relate to the distance in placement and to the proximal relationship between the coating material and the substrate. Historically, aluminide coatings have been formed by the so-called "pack cementation" method described in U.S. Pat. No. 3,257,230 to Wachtell et al., and U.S. Pat. No. 3,544,348 to Boone. In this method, the metal substrate is buried in a coating material in powder form that contains an aluminum source and halide activator. That is, the coating material has an in-contact relation with the substrate. Other in-contact coating media include coating tape and slurry. Because the media is applied directly to the surface to be treated, these methods represent variants of the pack cementation method. In fact, U.S. Pat. No. 5,334,417 to Rafferty et al. discusses using coating tape to form a pack cementation-style coating on a metal surface. U.S. Pat. No. 6,045,863 to Olson et al. employs a coating tape that produces a two-zone diffusion coating. U.S. Pat. No. 5,674,610 to Schaeffer et al. uses a coating tape to perform a chromium, not aluminide, diffusion coating. U.S. Pat. No. 4,004,047 to Grisik features a coating tape in which the aluminum source is a Fe—Al powder mixture. Also, U.S. Pat. No. 6,110,262 to Kircher et al. discloses a slurry for diffusion aluminide coating.

Somewhat different from the pack cementation method is the so-called "above-the-pack" coating method in which the metal substrate lies in a retort chamber apparatus above the coating material. The coating material is typically in powder form, and has an out-of-contact relation with the substrate. Besides an aluminum source and halide activator, the coating material may contain an oxide and modifier as required to reduce the activity of the halide activator. See e.g., U.S. Pat. No. 4,132,816 to Benden et al.; U.S. Pat. No. 4,148,275 to Benden et al.; U.S. Pat. No. 4,501,766 to Shankar et al., and U.S. Pat. No. 5,217,757 to Milianik et al. Essentially, these references describe vapor aluminide diffusion, whereby internal features of a metal part may be coated. A further variation is the chemical vapor deposition method of U.S. Pat. No. 5,658,614 described in Basta et al.

A problem in the use of diffusion aluminide coating for gas turbine engine parts has been the inability to consistently attain uniform coatings of inaccessible or hard to reach sections of the part to-be-coated. Methods that require in-contact relation between coating medium and the metal substrate cannot coat an inaccessible section, regardless of whether the medium is in powder form, a tape or a slurry.

The amount of coating medium applied to the substrate surface usually affects the diffused coating thickness. Previous in-contact coating methods result in a hit or miss approach to the application of coating medium for hard to for reach sections of the part. However, depending on the geometry and the irregularity of the section to be coated, using an in-contact coating mechanism such as a powder or slurry for hard to reach sections of the part likely results in an uneven coating layer applied to the substrate. In many instances the best that can be done to deliver coating medium to the hard to reach metal substrate is to estimate that an in-relation contact has been made. Further, disposing a slurry on a hard to reach part risks undetected or uncontrollable contact onto sections of the part that ought not be coated. Detecting a spotty or uneven application of the coating medium may be difficult. Moreover, when an undetectably uneven application of coating medium has been heated, detecting a non-uniform coating thickness is difficult.

Aluminide diffusion methods that allow an out-of-contact relation, such as above-the-pack cementation or vapor diffusion, may provide somewhat more control than in-contact methods. This is because in the above methods, diffusion coating occurs as a result of the entire surface of the part being automatically exposed to the aluminum vapor in the heating chamber. For example, relative to hard to reach surfaces, above-the-pack cementation has provided a way to deposit a metallic coating on internal surfaces of hollow articles, such as gas turbine blades and vanes. See U.S. Pat. No. 4,148,275 to Benden et al. Hollow gas turbine blades are placed in a chamber atop that in which the coating medium is placed. The coating medium, a powder, is heated to a temperature at which the Al halides vaporize and are directed into the blade hollows. See also U.S. Pat. No. 4,132,816 to Benden et al.

The Benden method, however, is quite limited and is useful only when coating the entire internal surface of hollow turbine engine parts is desired. This method requires specialized apparatus adapted so that the coating vapor may be pumped into the blade hollows. Such a specialized method is not readily applicable for localized repair of the aluminide coating of sections of turbine engine parts. Nor is the specialized Benden method and apparatus readily applicable for coating specific types of external features of a turbine engine part such as edge seals and platform underside pockets, which present no hollows into which vapor coating may be pumped, but bisect the blade.

Other attempts at localized aluminide diffusion coating rely only on an in-contact relation between the coating medium and substrate. See e.g., U.S. Pat. No. 6,045,863 to Olson et al. for applying a coating tape directly to the substrate surface to be repaired; U.S. Pat. No. 5,334,417 to Rafferty et al. for applying a coating tape to a localized area of metal substrate to be repaired; U.S. Pat. No. 5,658,614 to Basta et al. for applying a localized coating of platinum as a pretreatment to a section of a turbine blade to be repaired, then subjecting the blade to vapor diffusion to create a uniform coating over the pre-treated area. See also, U.S. Pat. No. 6,203,847 to Conner et al. U.S. Pat. No. 6,274,193 to Rigney et al. None of the cited references describes a method for aluminide coating of uneven or irregular surfaces.

Currently needed is a method for producing a targeted diffusion aluminide coating suitable for both first time and repair coating of hard to reach surfaces, particularly surfaces of turbine engine parts. Such a method should be capable of producing first time or repair coating on irregular surfaces. In addition, such a targeted aluminide coating method should minimize the possibility that non-targeted laterally adjacent areas of the substrate will also be coated during the localized process. The localized coating method needed will rely on an out-of-contact relation between the coating medium and substrate.

SUMMARY OF THE INVENTION

The present invention provides methods and compositions for forming an aluminide coating on a target surface of a metal substrate which is otherwise not easily accessible. The target surface bounds a contained spaced of the substrate. The present method is particularly useful when only a small portion of a metal substrate requires coating, and when extensive masking of the substrate would otherwise be required to apply coatings using conventional processes.

According to one embodiment of the invention, a method for forming an aluminide coating on a target surface of a metal substrate is provided. The target surface bounds a contained space of the substrate. The method comprises positioning a coating tape over the contained space to at least partially enclose said contained space. The coating tape is in out-of-contact relation with the target surface. The coating tape comprises a mixture comprising: (i) at least one aluminum source comprising from about 70% to about 99% by weight of the mixture, the aluminum source containing from about 20 wt. % to about 60 wt. % aluminum; and (ii) at least one halide activator comprising from about 1% to about 15% by weight of the mixture. The coating tape further comprises at least one binder. The target surface is heated to a temperature effective to cause the aluminum source to react with the activator and the target surface, thereby forming an aluminide coating on the target surface.

According to another embodiment of the invention, a method for forming an aluminide coating on a target surface of a metal substrate is provided. The target surface bounds a contained space of the substrate. The method comprises positioning a tape over the contained space to at least partially enclose said contained space, but in out-of-contact relation with the target surface. A slurry coating composition is then disposed on the tape. The slurry coating composition comprises (1) a solid pigment mixture, in the amount of from about 30% by weight to about 80% by weight of the slurry coating composition, the solid pigment mixture comprising Cr—Al alloy containing from about 20 wt. % Al to about 60 wt. % Al of the alloy; and LiF in an amount from about 0.3 wt. % to about 15 wt. % of the Cr—Al alloy; (2) at least one organic binder; and (3) a solvent. The tape is adapted to substantially decompose without residue upon heating to a decomposition temperature which is below a temperature effective to cause the alloy to react with the halide activator and the target surface. The target surface is heated to a temperature effective to cause the alloy to react with the activator and the target surface and thereby form an aluminide coating on the target surface.

Optionally, a masking material may be disposed onto an area of the metal substrate before positioning the coating tape. The area is laterally adjacent to the contained space and not within the contained space. The masking material inhibits the coating material from forming an aluminide coating on the laterally-adjacent area.

According to another embodiment of the invention, an article comprises a metal substrate having a target surface bounding a contained space formed by the substrate and a coating tape disposed over the contained space to at least partially enclose the space. The coating tape is in out-of-contact relation with the target surface. The coating tape comprises: (1) a mixture of (i) at least one aluminum source comprising from about 70% to about 99% by weight of the mixture, the aluminum source containing from about 20% wt. to about 60% wt. aluminum; and (ii) at least one halide activator comprising from about 1% to about 15% by weight of the mixture; and (2) at least one binder. An aluminide coating is formed on the target surface of the contained space upon heating the metal substrate to a temperature effective to cause the aluminum source to react with the halide activator and the target surface.

As used herein, "aluminum source" means elemental aluminum or a compound or alloy of aluminum.

As used herein, "target surface" means a portion of the surface of a metal substrate to be aluminide diffusion coated.

As used herein, "contained space" means is a space bounded by the target surface.

DETAILED DESCRIPTION OF THE INVENTION

The present invention provides methods for forming an aluminide coating on a target surface of a contained space of a metal substrate, and in particular metal substrates comprising turbine engine parts. The coating process may be used for forming either a first time or a repair coating on turbine engine parts, particularly parts made of nickel, and superalloys of nickel or cobalt.

The target surface to-be-coated may extend over a section of the metal substrate and include more than one feature, such as regularly occurring holes at spaced intervals. The target surface may have developed as an artifact created by metal fatigue or oxidation of the metal substrate through use. Examples of features that will benefit from localized coating of the present invention include indentations, depressions, through-holes, pockets, hollows, cut-outs, pits and the like. Target surfaces may take any shape, such as circular, ovoid, elliptical, square, rectangular, pentagonal and the like. In addition, the feature coated by the present method need not be concave, but may be a protrusion above the surface of the metal substrate, such as a fastener, e.g. a pin or the like. For such protruding features, so long as the coating material is positioned around the target surface in an out-of-contact relation with it to thereby create a contained space between the target surface and the coating material, the present method may be used to form an aluminide coating on the target surface. The contained space may take any volumetric shape, including, but not limited to, spherical, conical, cubical, tubular, helical, bell-shaped, v-shaped, pyramidal, cylindrical and discoidal.

Figure 1:
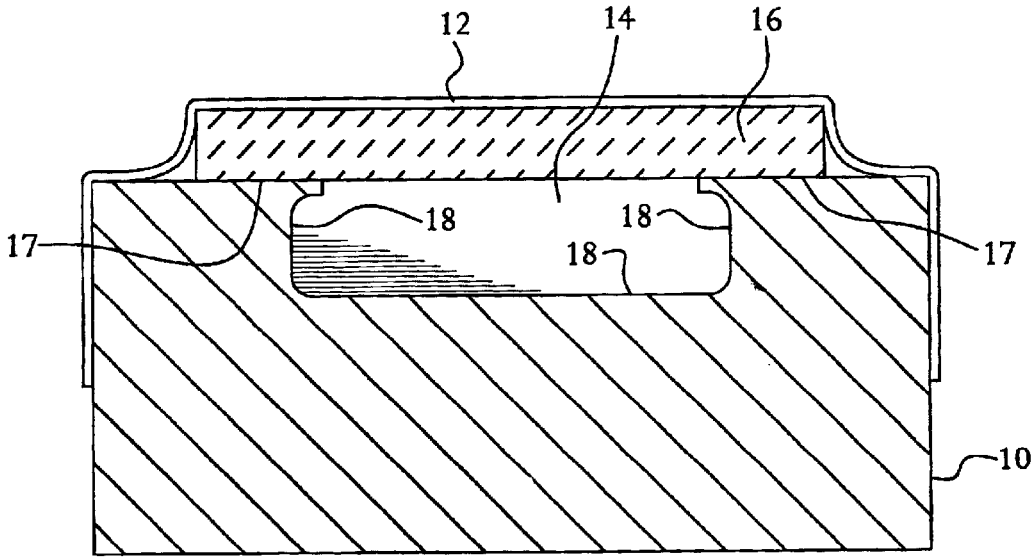
FIG. 1 shows a cross-sectional view of a coating tape covering a target surface on a turbine engine part in accordance with the method of the present invention.

In one embodiment of the method, shown in FIG. 1, a coating tape 16 is placed over a recess located in the surface of a metal substrate 10. The recess in substrate 10 forms a contained space 14. The coating tape is positioned to at least partially enclose the contained space 14. The walls of the contained space form a target surface 18 to be coated. The coating tape 16 is in out-of-contact relation with the target surface 18. It is the contained space 14 that creates the mechanism by which the present method achieves the deposition of a localized and directed coating on the target surface 18.

Figure 2:
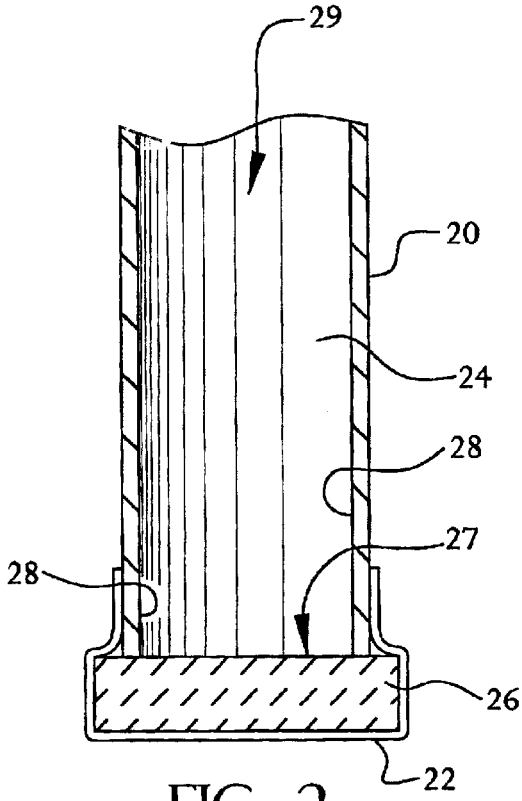
FIG. 2 shows another embodiment of the present invention in which a cross-section of the tubular volume of a turbine engine part forms the target surface to be coated.

FIG. 2 shows another embodiment whereby coating tape 26 is placed over one end 27 of a tubular member 20 having open ends 27 and 29. The tubular member may comprise, for example, a turbine engine part. Placement of the tape cooperates with tubular member to form a contained space 24 at tubular member end 27. The interior wall of member 20 adjacent end 27 defines a target surface 28 to be coated. Coating tape 26 is in out-of-contact relation with the target surface 28. Even though still open at one end, contained space 24 enables the placement of a diffusion aluminide coating on the target surface.

The part having the coating tape secured thereto is heated to a temperature effective to cause the deposition of a diffusion aluminide coating on the target surface. The target surface will receive a coating of varying thickness, depending on the distance from the coating tape. Moreover, the contained space may be partially enclosed by the coating material (not shown).

The present invention also provides a coating tape for use in the present methods. The coating tape comprises a mixture that includes at least one aluminum source comprising from about 70% to about 99% by weight of the mixture and at least one halide activator comprising about 1% to about 10% by weight of the mixture. The aluminum source contains from about 20% wt. to about 60% wt. aluminum. Optional components include an inhibitor of the coating activity and a ceramic filler. In one embodiment, the coating tape comprises a mixture of an aluminum source in powder form and a halide activator in powder form.

The aluminum source may be any number of suitable high melting point aluminum compounds that do not melt during the heating step of the diffusion coating. For example, elemental aluminum or aluminum alloys, such as Co—Al, Cr—Al, Fe—Al, Al—Si and mixtures thereof may be used. Aluminum comprises from about 20 wt. % to about 60 wt. % of the aluminum source; preferably from about 30 wt. % to about 60 wt. % of the source; and most preferably, from about 40 wt. % to about 55 wt. % of the source.

The at least one halide activator functions as the transporter of the aluminum ions (in the aluminum source) to the target surface being coated. The halide activator can be any one of a number of halide compounds, including aluminum trifluoride, sodium fluoride, lithium fluoride, ammonium fluoride, ammonium chloride, potassium fluoride, potassium bromide and mixtures thereof. The at least one activator comprises from about 1% to about 15% by weight of the mixture of aluminum source plus activator.

The inhibitor, such as chromium, cobalt, nickel, titanium and mixtures thereof, lowers the activity of the coating reaction. The inert ceramic material may be any material capable of inhibiting the constituents of the tape from sintering together during the coating process.

In one preferred embodiment of the present invention, the coating tape contains an aluminum source in powder form that is a chromium-aluminum (Cr—Al) alloy, which contains from about 20 wt. % to about 60 wt. % aluminum. In a further preferred embodiment, the coating tape contains lithium fluoride (LiF) in powder form as the halide activator. In a still further preferred embodiment, the powder mixture of the coating tape comprises a Cr—Al alloy containing from about 20 wt. % to about 60 wt. % aluminum and LiF as the halide activator.

The binder functions to strengthen the coating tape. The binder may be any material capable of holding the coating constituents together without detrimentally interfering with the properties of either the coating tape or the coated substrate. The binder must be capable of evaporating during the heating step without leaving an unwanted or detrimental residue. Suitable binders include polytetrafluoroethylene, polyethylene, polypropylene, urethane, acrylics, cellulose and mixtures thereof.

When the coating tape includes an optional filler material, the preferred filler is aluminum oxide (−220M or finer). The inert filler material functions to prevent the tape constituents from sintering together during the diffusion coating process and therefore may be any material that serves this function.

The coating tape is formed from the above components in a conventional manner using manufacturing techniques discussed in U.S. Pat. No. 5,334,417, the entirety of which is incorporated herein by reference. In general, the mixture of an aluminum source and halide activator, binder and, if desired, inert filler are mixed together, and rolled into a tape of desired thickness, which is preferably between about 0.038 cm (0.015 inches) and about 0.229 cm (0.090 inches). The tape is formed so that it may be applied to the metal substrate with a suitable adhesive. If not self-sticking, the tape may be applied with any conventional adhesive that does not detrimentally interfere with the coating process. The adhesive must be capable of evaporating during the heating step without leaving detrimental and unwanted residue. The adhesives are conventional, and may include, for example, Scotch® 465 Adhesive Transfer Tape or 3M® Super 77 Spray Adhesive. Preferably, the tape bears adhesive on one side and is therefore self-sticking.

As shown in FIG. 1, the coating tape 16 is applied in at least one layer to edges 17 of the substrate laterally adjacent the target surface. The number of layers applied depends on the desired thickness of the resultant coating. As shown in FIG. 1, to ensure that the tape remains in place over the target area and thereby defines a contained space during the heating step, a metal foil 12, preferably made of nickel, may be positioned around the contained area in a manner disclosed in U.S. Pat. No. 6,045,863, the entirety of which is incorporated herein by reference.

Figure 3:
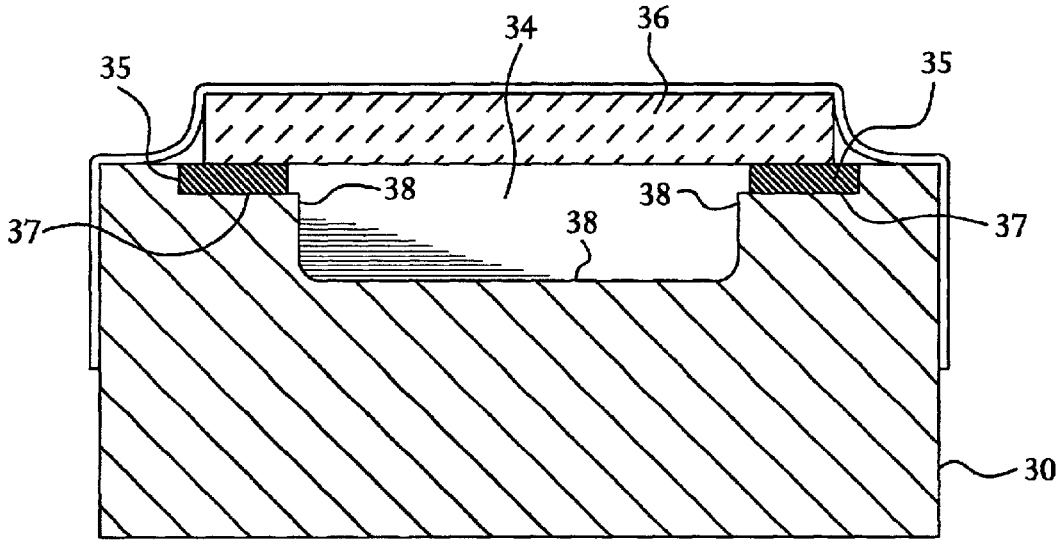
FIG. 3 shows a masking embodiment of FIG. 1 in which areas laterally adjacent to the target surface are masked.

Depending on the location of the target surface and the part on which it resides, it may be desirable to minimize stray aluminide coating on the metal substrate adjacent to the target surface. That is, it may be beneficial to minimize incidental diffusion aluminide coating on an area other than the target surface. Such incidental coating would, of course, result from the positioning of the coating tape directly onto the laterally adjacent edges 17 as shown in FIG. 1. To prevent this, FIG. 3 shows a masking embodiment of the invention in which a masking material 35 is first applied to portions 37 of the metal substrate 30 proximal to the target surface where the coating tape 36 will be placed. Coating tape 36 is placed over a recess located on the surface of metal substrate 30. The walls of the contained space 34 form a target surface 38 to be coated. Depending on the strength of the masking material, masking may minimize, but not altogether prevent, coating outside of the target surface. A combined use of masking material 35 and coating tape 36 allows the exercise of greater control to more precisely define the target surface to be coated.

The masking material may comprise any material which will inhibit the deposition of an aluminide coating in the area of the metal substrate which is masked. Several different types of masking compounds are commercially available for use with the present invention. One type is comprised primarily of metal oxides such as aluminum and chromium oxide. Compound "M1" produced by Alloy Surfaces, Wilmington, Del. and Compound "T-Block 1" produced by Chromalloy Israel Ltd. are examples of this type of masking compound. A second type incorporates various amounts of metallic materials such as nickel powder or nickel-aluminum powder as well as ceramic oxides. Such maskants allow more complete masking of target surfaces from aluminum vapors. Compound "M7" produced by Alloy Surfaces, Wilmington, Del. and compound "T-Block 2" produced by Chromalloy Israel Ltd. are examples of this type of masking compound. These compounds are available as powders which can be mixed with organic binders to form a paste for application to the surface requiring masking. They are also available in some cases as pre-formed tapes or putty.

According to another embodiment of the invention, a coating slurry is employed as the source of the aluminide coating material in lieu of a coating tape, for forming a localized aluminide coating. A tape (other than a coating tape) is positioned on the substrate as described above. The tape serves as a foundation on which the slurry is deposited, but does not itself otherwise contain the slurry contents. The tape is of a type that will decompose entirely and cleanly without unwanted or detrimental residue when the substrate is heated to a temperature below a temperature effective to cause a halide activator to react with an aluminum source. Suitable tapes include Scotch® Magic™ Tape 810.

The slurry coating composition comprises a solid pigment mixture of an aluminum source and a halide activator as well as an organic binder and a solvent. The aluminum source is in the amount of from about 30% by weight to about 80% by weight of the slurry coating composition and comprises a Cr—Al alloy containing from about 20 wt. % Al to about 60 wt. % Al. The halide activator is LiF in an amount from about 0.3 wt. % to about 15 wt % of the Cr—Al alloy.

The organic binder is selected based upon the following considerations. The binder must be inert relative to the Cr—Al alloy and the halide activator. It must not dissolve the activator and should promote an adequate shelf-life for the slurry. The binder should burn off entirely without leaving unwanted or detrimental residue. A suitable organic binder is hydroxypropylcellulose. One such hydroxypropylcellulose is available as Klucel™ from Aqualon Company.

The solvent in the slurry is selected by considering volatility, flammability and toxicity. Preferable solvents in this embodiment include the lower alcohols, i.e., $C_1$–$C_6$ alcohols such as ethyl alcohol and isopropyl alcohol, N-methylpyrrolidine (NMP) and water. These solvents are included so as to produce solutions having a wide range of viscosities.

Figure 4:
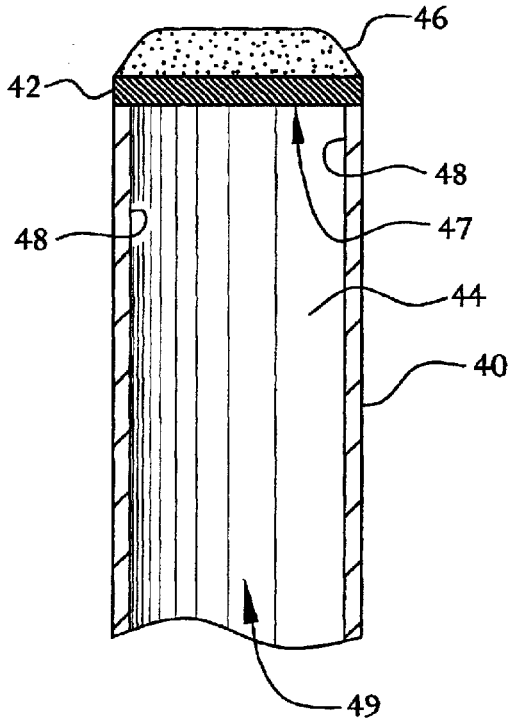
FIG. 4 shows an embodiment of the present invention using a slurry as the coating material.

FIG. 4 shows the slurry coating composition in use in the present method. Tape 42 is placed over one end 47 of a tubular member 40 having open ends 47 and 49. Placement of the tape cooperates with the tubular member to form a contained space 44 at tubular member end 27. The interior wall of member 40 adjacent end 47 defines a target surface 48 to be coated. A slurry coating composition 46 is then disposed over the tape by conventional methods such as brushing, spraying, and dipping. The method of application depends on the fluidity of the slurry coating composition as well as on the geometry of the feature that forms the target surface. The minimum recommended applied thickness for the slurry coating is about 0.25 mm (0.010 inches). There is no known maximum thickness that can be applied before the uniformity of the coating is compromised.

If more than one coating layer is required, it is preferable to dry the applied slurry layers, either with warm air, in a convection oven, under infrared lamps or the like. In a further embodiment not shown, a masking material as used in FIG. 3 may be placed on the metal substrate lying laterally adjacent to the target surface before the covering tape 42 is positioned to create contained space 44.

Once the coating material, either the coating tape or slurry, and in some embodiments the masking material, has been disposed, the target surface is heated. The heating step is performed at a temperature effective to cause aluminum ions in the aluminum source, either as a powder in the coating tape or as a solid pigment in the slurry, to react with the halide activator to form Al-halide intermediates. The metal atoms of the target surface react with the Al-halide intermediates by reducing them and thereby forming intermetallic compounds. The composition of the intermetallic compounds depends of course on the metal or alloy of the metal substrate. For a nickel or nickel superalloy engine part, the intermetallic compounds may include $Ni_2Al_3$, NiAl, or $NiAl_3$. The intermetallic compounds are deposited on and below the surface of the substrate. The depth to which the intermetallic compounds extend below the surface plane of the coated substrate indicates the thickness of the coating.

Because aluminide diffusion coating is a reducing reaction, the heating step is generally conducted in a non-oxidizing atmosphere, typically in a retort chamber in the presence of an inert gas. An appropriate temperature range for the heating step is from about 871° C. (1600° F.) to about 1121° C. (2050° F.), preferably from about 1010° C. (1850° F.) to about 1066° C. (1950° F.). The duration of the heating is not critical, but is advantageously in the range of from about 2 to about 12 hours.

The thickness of the resultant aluminide coating depends on several factors, including the heating duration, the temperature, the activity and mass of aluminum in the particular aluminum source used, as well as on the concentration of the halide activator. Because the coating material is not in contact with the target surface, the present invention achieves targeted, localized coating by mimicking the process of vapor diffusion coating. Specifically, the present invention creates a contained space in which diffusion aluminide coating can occur. The contained space of the present invention creates in essence a localized retort chamber in the vicinity of the target surface. The present invention relies on the throwing power of the halide activator to generate Al-halide intermediates within the contained space. These intermediates react with the metal atoms on and beneath the target surface. In effect, the technical solution of the present invention is to create, by use of a coating tape or slurry coating, a confined space in which the target surface is aluminide-coated by vapor diffusion by virtue of the throwing power of the halide activator in the coating material.

The thickness of the targeted, localized coating depends on the throwing power of the specific halide activator used as well as on the distance between the coating material and the target surface. Generally, the throwing power of halide activators allows coating to occur using the present invention up to a distance of about 0.64 cm (0.25 inches). If the target surface is uneven or curves away from the coating material as shown in FIG. 2 and FIG. 4, the thickness of the coating will continuously vary over the target surface, depending on the change in distance from the coating material.

The present invention is further illustrated in the following examples, which are intended to exemplify, not limit, the practice of the invention.

EXAMPLE 1

A powder mix of approx. 94 wt %-325 mesh 44Al-56Cr alloy powder and 6 wt %-325 mesh LiF powder was blended and subsequently made in to a tape approximately 1.27 cm (0.50 inch) thick and 2.54 cm (1 inch) wide. A piece of tape approximately 0.76 cm (0.3 inch)×0.76 cm (0.3 inch) square was affixed to the end of a IN600 nickel alloy tube having an outside diameter of approximately 0.64 cm (0.25 inch) and an inside diameter of approximately 0.47 cm (0.185 inch). The tape was held in place by a small piece of 0.05 mm (0.002 inch) thick nickel foil. The tube was placed in a retort which was purged with argon and heated to 1050° C. (1925° F.) and held at that temperature for 4 hours. Upon cooling the tube was removed and the tape residue removed by brushing. The tube was sectioned longitudinally and prepared for metallographic examination by mounting in epoxy and polishing with SiC abrasive paper. A final polish was done with an aluminum oxide slurry. Examination of the tube interior revealed an aluminide coating formed approximately 0.51 cm (0.200 inch) up the interior of the tube walls. The coating was approximately 0.04 mm (0.0015 inch) thick near the tube end and tapered to approximately 0.02 mm (0.0009 inch) at a distance of approximately 0.51 cm (0.200 inch) away from the tube end.

EXAMPLE 2

A tape similar to that of Example 1 was placed on the back side of a turbine engine combustor liner made from PWA 1455 nickel alloy. On the back side of this liner was an array of cast pin features approximately 0.76 cm (0.030 inch) in diameter and approximately 0.25 cm (0.100 inch) high spaced approximately 0.18 cm (0.070 inch) apart. The tape was placed so that it rested on the tips of these pins, out of contact from the pin walls and the back side of the liner. The liner was placed in a retort which was purged with argon and heated to 1050° C. (1925° F.) and held for 4 hours. Upon cooling the liner was removed and the tape residues removed by brushing. The liner was sectioned and prepared for metallographic examination by mounting in epoxy and polishing with SiC abrasive paper. A final polish was done with an aluminum oxide slurry. Metallographic examination showed that an aluminide coating approximately 0.04 mm (0.0015 inch) thick formed along the sides of the pins and the back side of the liner.

EXAMPLE 3

A CM-186 nickel alloy turbine blade having a "pocket" feature approximately 2.54 cm (1 inch) long and 1.27 cm (0.5 inch) wide and approximately 0.508 cm (0.200 inch) deep was plated with platinum and diffused in argon for 2 hours at 1080° C. (1975° F.). A piece of tape similar to that of Example 1 approximately 3.05 cm (1.2 inch) long×1.52 cm (0.6 inch) wide was placed over the pocket area, out of contact with the pocket side walls and interior. The blade was placed in a retort which was purged with argon and heated to 1050° C. (1925° F.) and held for 4 hours. Upon cooling, the blade was removed and the tape residues removed by brushing. The blade was sectioned through the pocket area and prepared for metallographic examination by mounting in epoxy and polishing with SiC abrasive paper. A final polish was done with an aluminum oxide slurry. Metallographic examination showed that a platinum aluminide coating approximately 0.045 mm (0.0018 inch) thick formed in the interior of the pocket.

EXAMPLE 4

A Mar-M-002 nickel alloy turbine blade has a ceramic thermal barrier coating on the convex side of the blade airfoil and a series of cooling passages approximately 0.04 cm (0.015 inch) wide and 0.19 cm (0.075 inch) long on the concave side of the blade airfoil. A tape similar to that of Example 1 was placed over the cooling holes on the convex side of the airfoil. The blade was placed in a retort which was purged with argon and heated to 1050° C. (1925° F.) and held for 4 hours. Upon cooling the blade was removed and the tape residues removed by brushing. The ceramic thermal barrier coating was intact. The blade was sectioned through the cooling holes and prepared for metallographic examination by mounting in epoxy and polishing with SiC abrasive paper. A final polish was done with an aluminum oxide slurry. Metallographic examination showed that an aluminide coating approximately 0.05 mm (0.002 inch) thick formed in the interior of the airfoil cooling holes along the entire length of the cooling passages. An aluminide coating approximately 0.09 mm (0.0035 inch) thick is formed on the airfoil convex surface in contact with the coating tape.

EXAMPLE 5

A blade similar to that of Example 4 is prepared except a ceramic masking compound was placed between the coating tape and the airfoil convex surface. The blade was placed in a retort which was purged with argon and heated to 1050° C. (1925° F.) and held for 4 hours. Upon cooling the blade was removed and the tape residues removed by brushing. The ceramic thermal barrier coating was intact. The blade was sectioned through the cooling holes and prepared for metallographic examination by mounting in epoxy and polishing with SiC abrasive paper. A final polish was done with an aluminum oxide slurry. Metallographic examination showed that an aluminide coating approximately 0.025 mm (0.001 inch) thick formed in the interior of the airfoil cooling holes along the entire length of the cooling passages. The presence of the masking compound between the coating tape and the blade convex surface reduced the aluminide coating thickness on the blade exterior surface to approximately 0.025 mm (0.001 inch).

All references discussed herein are incorporated by reference. One skilled in the art will readily appreciate that the present invention is well adapted to carry out the objects and obtain the ends and advantages mentioned, as well as those inherent therein. The present invention may be embodied in other specific forms without departing from the spirit or essential attributes thereof and, accordingly, reference should be made to the appended claims, rather than to the foregoing specification, as indicating the scope of the invention.

What is claimed is:

1. A method for forming an aluminide coating on a target surface of a metal substrate bounding a contained space formed by a feature of the substrate comprising:

a) positioning a coating tape over said contained space to at least partially enclose said contained space, wherein the coating tape is in out-of-contact relation with the target surface and comprises:
   (1) a mixture comprising:
      (i) at least one aluminum source comprising from about 70% to about 99% by weight of the mixture, the aluminum source containing from about 20 wt. % to about 60 wt. % aluminum; and
      (ii) at least one halide activator comprising from about 1% to about 15% by weight of the mixture; and
   (2) at least one binder;

b) heating the target surface to a temperature effective to cause the halide activator to react with aluminum ions from the aluminum source to form an Al-halide intermediate within the contained space, which Al-halide intermediate reacts with the target surface, and thereby forms an aluminide coating on the target surface.

2. The method of claim 1, wherein the aluminum source is a Cr—Al alloy containing from about 20 wt. % to about 60 wt. % Al in the alloy.

3. The method of claim 1, wherein the halide activator is LiF.

4. The method of claim 2, wherein the halide activator is LiF.

5. A method for forming an aluminide coating on a target surface of a metal substrate bounding a contained space of the substrate comprising:

a) disposing a masking material onto an area of the metal substrate, said area being laterally adjacent to the contained space and not within the contained space;

b) positioning a coating tape over said contained space to at least partially enclose said contained space, wherein the coating tape is in out-of-contact relation with the target surface and comprises:
   (1) a mixture comprising:
      (i) at least one aluminum source comprising from about 70% to about 99% by weight of the mixture, the aluminum source containing from about 20 wt. % to about 60 wt. % aluminum; and
      (ii) at least one halide activator comprising from about 1% to about 15% by weight of the mixture; and
   (2) at least one binder;

c) heating the target surface to a temperature effective to cause the halide activator to react with the aluminum ions from the aluminum source to form an Al-halide intermediate within the contained space, which Al-halide intermediate reacts with the target surface, and thereby form forms an aluminide coating on the target surface, whereby the masking material inhibits the coating material from forming an aluminide coating on the laterally-adjacent area.

6. A method for forming an aluminide coating on a target surface of a metal substrate, said target surface bounding a contained space formed by said metal substrate, the method comprising:

a) positioning a tape over said contained space to at least partially enclose said contained space but in out-of-contact relation with the target surface, wherein the tape is in out-of-contact relation with the target surface;

b) disposing a slurry coating composition on the tape, the slurry coating composition comprising:
   (1) a solid pigment mixture, in the amount of from about 30% by weight to about 80% by weight of the slurry coating composition, said solid pigment mixture comprising:
      (i) Cr—Al alloy containing from about 20 wt. % Al to about 60 wt. % Al of said alloy; and
      (ii) LiF in an amount from about 0.3 wt. % to about 15 wt. % of said Cr—Al alloy;
   (2) at least one organic binder; and
   (3) a solvent;

the tape being adapted to substantially decompose without residue upon heating to a decomposition temperature which is below a temperature effective to cause the alloy to react with the LiF and form an Al—F intermediate which reacts with the target surface; and c) heating the target surface to a temperature effective to cause the alloy to react with the LiF to form an Al—F intermediate which reacts with the target surface and thereby forms an aluminide coating on the target surface.

7. The method of claim 6, further comprising the step of before positioning the tape, disposing a masking material onto an area of the metal substrate, said area being laterally adjacent to the contained space and not within the contained space, whereby the masking material inhibits the slurry coating composition from forming an aluminide coating on the laterally-adjacent area.

8. A method for forming an aluminide coating on a target surface of a metal substrate bounding a contained space formed by a feature of the substrate comprising:

a) positioning a coating tape over said contained space to at least partially enclose said contained space, wherein the coating tape is in out-of-contact relation with the target surface and comprises:

(1) a mixture comprising:

(i) at least one aluminum source comprising from about 90% to about 99% by weight of the mixture, the aluminum source containing from about 20 wt. % to about 60 wt. % aluminum; and (ii) at least one halide activator comprising from about 1% to about 10% by weight of the mixture;

(2) at least one binder;

b) heating the target surface to a temperature effective to cause the halide activator to react with the aluminum ions from the aluminum source to form an Al-halide intermediate within the contained space, which Al-halide intermediate reacts with the target surface, and thereby forms an aluminide coating on the target surface.

9. The method of claim 8, wherein the aluminum source is a Cr—Al alloy containing from about 20 wt. % to about 60 wt. % Al in the alloy.

10. The method of claim 9, wherein the halide activator is LiF.

11. The method of claim 8, wherein the halide activator is LiF.

12. A method for forming an aluminide coating on a target surface of a metal substrate bounding a contained space of the substrate comprising:

a) disposing a masking material onto an area of the metal substrate, said area being laterally adjacent to the contained space and not within the contained space;

b) positioning a coating tape over said contained space to at least partially enclose said contained space, wherein the coating tape is in out-of-contact relation with the target surface and comprises:

(1) a mixture comprising:

(i) at least one aluminum source comprising from about 90% to about 99% by weight of the mixture, the aluminum source containing from about 20 wt. % to about 60 wt. % aluminum; and (ii) at least one halide activator comprising from about 1% to about 10% by weight of the mixture;

(2) at least one binder;

c) heating the target surface to a temperature effective to cause the halide activator to react with the aluminum ions from the aluminum source to form an Al-halide intermediate within the contained space, which Al-halide intermediate reacts with the target surface, thereby forming an aluminide coating on said target surface at least partially enclosing said contained space, whereby the masking material inhibits the coating material from forming an aluminide coating on the laterally-adjacent area.

13. The method according to claim 1 wherein the contained space is formed by a feature selected from the group consisting of indentations depressions, holes, pockets, hollows, cut-outs, pits and protrusions.

14. The method according to claim 5 wherein the contained space is formed by a feature selected from the group consisting of indentations, depressions, holes, pockets, hollows, cut-outs, pits and protrusions.

15. The method according to claim 6 wherein the contained space is formed by a feature selected from the group consisting of indentations, depressions, holes, pockets, hollows, cut-outs, pits and protrusions.

16. The method according to claim 8 wherein the contained space is formed by a feature selected from the group consisting of indentations, depressions, holes, pockets, hollows, cut-outs, pits and protrusions.

17. The method according to claim 12 wherein the contained space is formed by a feature selected from the group consisting of indentations, depressions, holes, pockets, hollows, cut-outs, pits and protrusions.

* * * * *